US008827413B2

(12) United States Patent
Kanda et al.

(10) Patent No.: US 8,827,413 B2
(45) Date of Patent: Sep. 9, 2014

(54) RECORDING APPARATUS AND PATTERN RECORDING METHOD

(75) Inventors: Hidehiko Kanda, Yokohama (JP); Wakako Yamamoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 12/825,203

(22) Filed: Jun. 28, 2010

(65) Prior Publication Data

US 2011/0001778 A1 Jan. 6, 2011

(30) Foreign Application Priority Data

Jul. 2, 2009 (JP) ..... 2009-157914

(51) Int. Cl.

| | |
|---|---|
| ***B41J 29/393*** | (2006.01) |
| ***B41J 11/00*** | (2006.01) |
| ***B41J 19/14*** | (2006.01) |
| ***B41J 25/308*** | (2006.01) |

(52) U.S. Cl.

CPC ..... *B41J 25/308* (2013.01); *B41J 11/0095* (2013.01); *B41J 19/142* (2013.01); *B41J 11/0025* (2013.01)

USPC ..... 347/19; 347/5; 347/8; 347/9; 347/14

(58) Field of Classification Search

USPC ..... 347/5, 9, 12, 14, 19

See application file for complete search history.

(56) References Cited

U.S. PATENT DOCUMENTS

| | | | | |
|---|---|---|---|---|
| 6,164,745 | A | 12/2000 | Nagoshi et al. | |
| 7,959,259 | B2 * | 6/2011 | Yamaguchi et al. | 347/41 |
| 2001/0015818 | A1 * | 8/2001 | Kawanabe et al. | 358/1.15 |
| 2006/0044334 | A1 * | 3/2006 | Fujita et al. | 347/12 |

FOREIGN PATENT DOCUMENTS

| | | | |
|---|---|---|---|
| JP | H07-081190 | A | 3/1995 |
| JP | 2006-015678 | A | 1/2006 |

* cited by examiner

*Primary Examiner* — Justin Seo

(74) *Attorney, Agent, or Firm* — Canon USA Inc IP Division

(57) ABSTRACT

A recording apparatus or a method for recording a pattern according to the present invention can record patterns for adjusting a recording position deviation between a forward direction and a backward direction of a scanning direction at a position in the scanning direction through which both of a first recording medium and a second recording medium smaller than the first recording medium in the scanning direction pass.

15 Claims, 13 Drawing Sheets

RECORDING APPARATUS AND PATTERN RECORDING METHOD

BACKGROUND OF THE INVENTION

1. Field of the Invention

The present invention relates to a recording apparatus which records an image by discharging ink from a recording head and a pattern recording method executed by the recording apparatus.

2. Description of the Related Art

An inkjet recording apparatus includes a platen on which a recording medium is placed and a recording head which faces the platen and executes scanning in forward and backward directions and performs recording on the recording medium by discharging ink thereto while scanning with the recording head. Particularly, the inkjet recording apparatus can perform high speed recording by discharging ink while scanning in both of a forward direction and a backward direction, which is referred to as bidirectional recording.

However, when a distance between a surface on which an ink discharge port of the recording head is disposed and a recording medium (i.e., referred to as "a paper gap") varies in a scanning direction, a deviation occurs between an impact position of an ink droplet discharged in the forward direction and an impact position of an ink droplet discharged in the backward direction.

Japanese Patent Application Laid-open No. 2006-015678 has discussed a technique for recording a test pattern for adjusting impact positions of ink droplets in the forward and backward directions across the entire width in a scanning direction of a recording area on a recording medium. The invention described in Japanese Patent Application Laid-open No. 2006-015678 corrects discharging timing of at least one of the forward and backward directions to minimize an average value of deviation amounts at respective positions. Accordingly, the deviation of the impact positions of ink droplets in the scanning direction is decreased.

In addition to the above recording position deviation between the forward direction and the backward direction, many kinds of a recording position deviation such as a recording position deviation among nozzle arrays and a recording position deviation caused by nozzle arrays inclination are considered as the impact position deviation (i.e., the recording position deviation) occurring at the inkjet recording apparatus. Regarding these items, it has been required to record a test pattern for a plurality of items in the scanning direction to record the test pattern in a shortest time on fewest recording sheets.

A commonly-used inkjet recording apparatus supports a plurality of types of recording sheets of different sizes in the scanning direction such as an A4 size which is most popular plain paper for recording documents, a letter-size, an L-size which is most popular photo-dedicated paper for recording photo images, and a 4×6 size. With such a recording apparatus, it has been desired that a recording position deviation is appropriately adjusted at a recording sheet which is relatively small-sized in the scanning direction such as L-size and 4×6 size and specially required high quality photo recording.

However, Japanese Patent Application Laid-open No. 2006-015678 has discussed the technique for recording a test pattern for adjusting impact positions of ink droplets in the forward and backward directions across the entire width in the scanning direction but has not discussed about recording a test pattern for a plurality of items in the scanning direction. Further, there is no discussion about appropriate adjustment of the recording position deviation corresponding to a recording sheet which is relatively small-sized in the scanning direction when recording is performed on a plurality of types of recording sheets having different sizes in the scanning direction.

SUMMARY OF THE INVENTION

According to an aspect of the present invention, there is provided a recording apparatus including a recording unit configured to perform recording on a first recording medium and a second recording medium which is smaller than the first recording medium in a scanning direction by scanning with a recording head which includes a plurality of nozzle arrays to discharge ink in a forward direction and a backward direction of the scanning direction, a conveyance unit configured to convey a recording medium in a direction perpendicular to the scanning direction, and a pattern recording unit configured to record patterns for adjusting a recording position deviation between the forward direction and the backward direction and a pattern for adjusting a recording position deviation in the scanning direction of the different nozzle arrays on the first recording medium along the scanning direction using the recording head, wherein the pattern recording unit records, on the first recording medium sequentially in the scanning direction, the patterns for adjusting the recording position deviation between the forward direction and the backward direction at a position in the scanning direction through which the first recording medium and second recording medium pass.

According to another aspect of the present invention, there is provided A method for recording a pattern including performing recording on a first recording medium or a second recording medium which have different sizes in a scanning direction by scanning backward and forward with a recording head which includes a plurality of nozzle arrays to discharge ink in a forward direction and a backward direction of the scanning direction, recording patterns for adjusting a recording position deviation between the forward direction and the backward direction and a pattern for adjusting a recording position deviation in the scanning direction of the different nozzle arrays on the first recording medium along the scanning direction using the recording head, and recording, on the first recording medium sequentially in the scanning direction, the patterns for adjusting the recording position deviation between the forward direction and the backward direction at a position in the scanning direction through which the first recording medium and second recording medium pass.

According to the present invention, when a test pattern for a plurality of items including a recording position deviation between the forward direction and the backward direction is recorded, the recording position deviation can be appropriately adjusted for a recording sheet which is relatively small-sized in the scanning direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
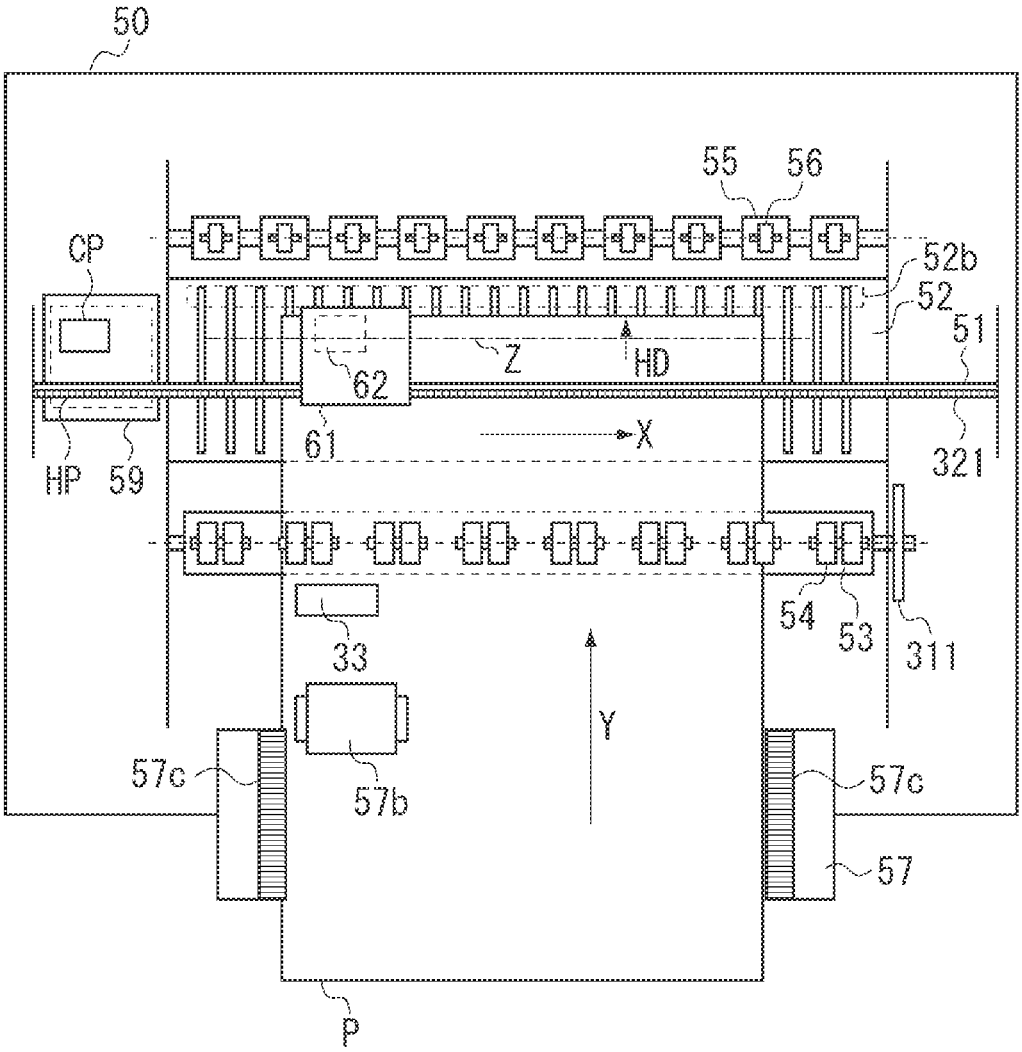
FIG. 1 is a plane view of a main part of an inkjet recording apparatus which can be adapted to the present invention.
Figure 2:
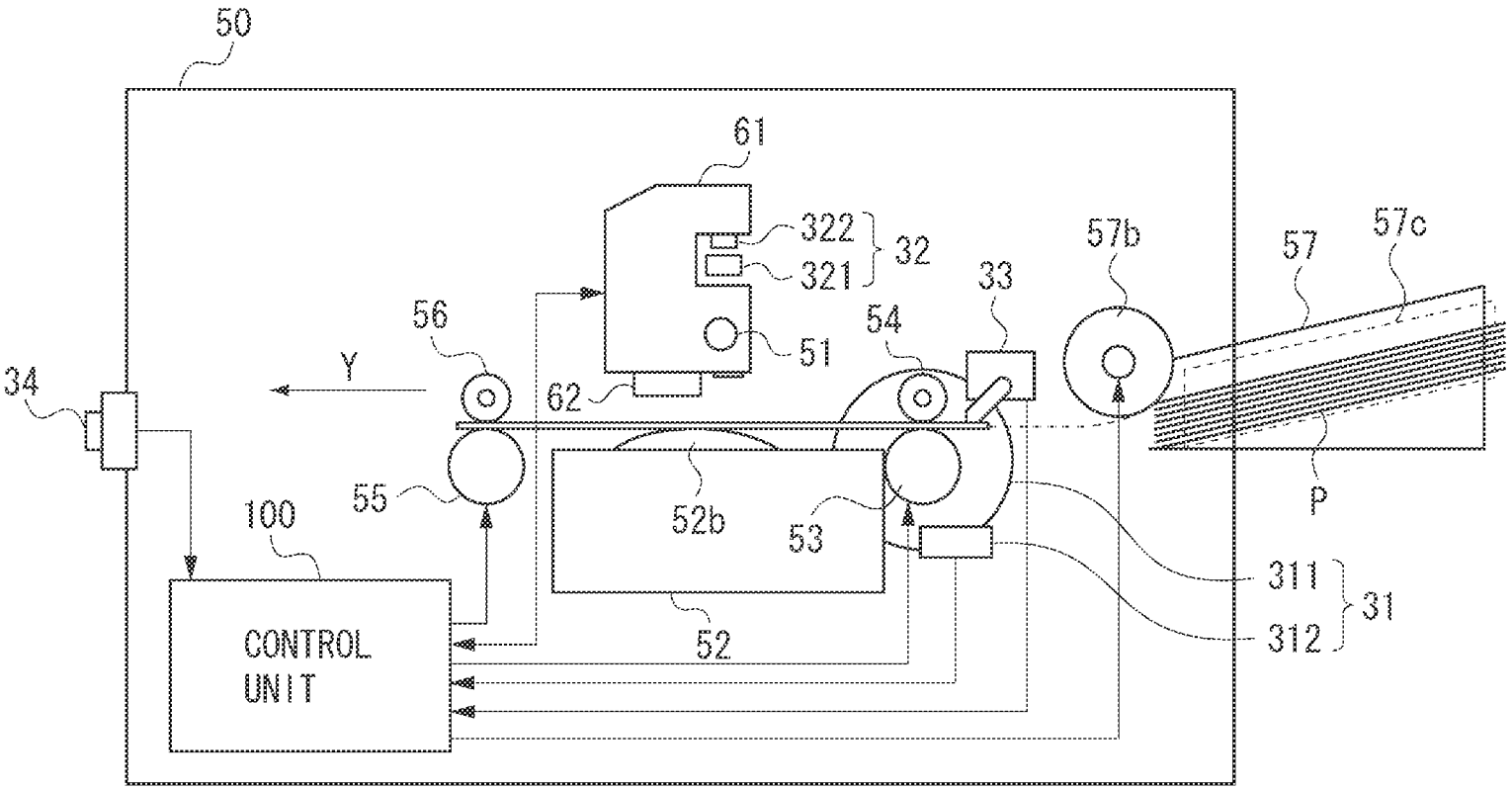
FIG. 2 is a side view of the inkjet recording apparatus which can be adapted to the present invention.

FIG. 1 is a plane view of a main part of a recording apparatus according to an exemplary embodiment of the present invention, and FIG. 2 is a side view thereof. The recording apparatus according to the present exemplary embodiment (i.e., an inkjet recording apparatus 50) includes a platen 52 as "a positioning surface" on which a recording sheet P as a "recording medium" is placed. Further, the inkjet recording apparatus 50 includes a recording head 62 which is mounted to face the platen 52 and a carriage 61 which can reciprocate along a scanning direction X of the recording sheet P on the platen 52. The inkjet recording apparatus 50 performs recording by discharging ink from the recording head 62 onto the recording sheet P while scanning a recording surface of the recording sheet P with the recording head 62.

A sheet feed tray 57 capable of stacking a number of recording sheets P is arranged at the most upstream side in a sub-scanning direction Y of the recording sheet P. The plurality of recording sheets P stacked on the sheet feed tray 57 are separated one by one by friction resistance between an outer circumferential surface of a sheet feeding roller 57*b* which rotationally operates and a separation pad (not illustrated) which is arranged to face the sheet feeding roller 57*b* and elastically urge the recording sheet P from a back thereof. Then, the recording sheet P is fed downstream in the sub-scanning direction Y which is perpendicular to the scanning direction X. In the following description, "left" and "right" respectively indicate the left and right directions directing to the downstream side of the sub-scanning direction Y.

A sheet feed guide 57*c* which can slide in a width direction of the sheet P, that is, in the scanning direction X, is arranged at the sheet feed tray 57. A position of the sheet guide 57*c* is set by a user according to the width of the recording sheet to be stacked on the sheet feed tray 57. A number of the recording sheets are fed one by one to a predetermined position on the platen 52 via a conveyance path from the sheet feed tray 57 to the platen 52 by the action of the sheet guide 57*c*.

Figure 3:
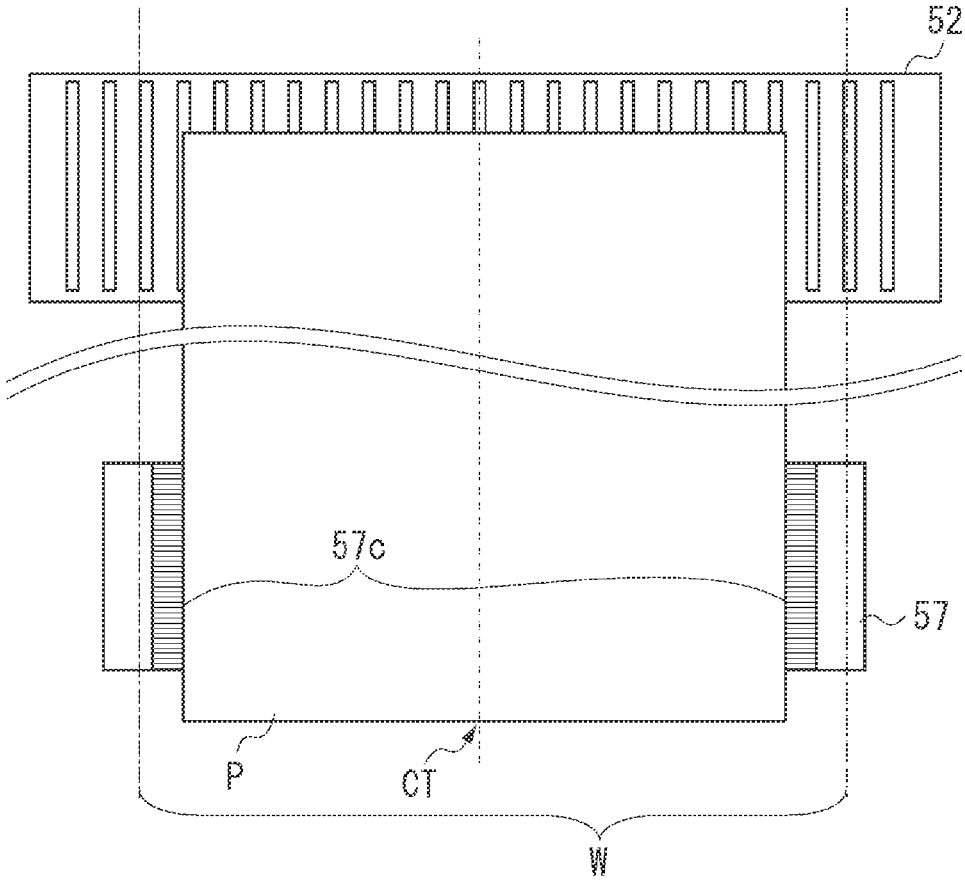
FIG. 3 illustrates a feeding position of a recording sheet.

In the following, a positional relation among the sheet feed tray 57, the sheet feed guide 57*c*, the recording sheet P, and the platen 52 will be described with reference to FIG. 3. FIG. 3 illustrates the sheet feed tray 57 on which the sheet feed guide 57*c* is arranged at a position to be bilaterally symmetric by reference to a sheet feed tray center CT. The recording sheet P is fed along the center CT of a conveyance path W indicated by a pair of alternate long and short dash lines and is placed at the center of the platen 52. Such sheet feeding method is referred to as "center sheet feeding" in the following description.

As illustrated in FIGS. 1 and 2, a sheet conveyance roller 53 is arranged at the downstream side of the sheet feeding roller 57*b* in the sub-scanning direction Y of the recording sheet P. The sheet conveyance roller 53 rotates to convey the recording sheet P downward in the sub-scanning direction Y. A plurality of driven rollers 54 is rotated as following to conveyance of the recording sheet P while respectively contacting to the recording sheet P. Accordingly, the recording sheet P is conveyed in the sub-scanning direction while being pressed to and closely contacted to the outer circumferential surface of the sheet conveyance roller 53.

A rotary encoder 31 (see FIG. 2) is arranged at the vicinity of the sheet conveyance roller 53. The rotary encoder 31 detects, with a rotary scale sensor 312 (see FIG. 2), slits which are formed at the same intervals along the outer circumference of a rotary scale 311 rotated in conjunction with the rotation of the sheet conveyance roller 53. Then, the rotary encoder 31 inputs a detection signal which varies according to the rotation of the sheet conveyance roller 53 into a control unit 100 (see FIG. 2). The control unit 100 detects rotation speed of the sheet conveyance roller 53 based on the detection signal.

A sheet detection device 33 is arranged between the sheet feeding roller 57*b* and the sheet conveyance roller 53. The sheet detection device 33 includes a lever which rotates in the conveyance direction of the recording sheet P and detects a leading edge HD of the conveyed recording sheet P by the rotation of the lever as an edge of the lever is pushed by the leading edge HD of the recording sheet P. The sheet detection device 33 detects the leading edge HD of the recording sheet P fed by the sheet feeding roller 57*b* and inputs the detection signal into the control unit 100. The recording sheet P is conveyed by a predetermined amount from a position where the leading edge is detected by the sheet detection device 33 and placed on the platen 52 facing the carriage 61.

The carriage 61 is arranged to be capable of reciprocating in the scanning direction X along a carriage guide shaft 51. A linear encoder 32 (see FIG. 2) mounted on the carriage 61 detects, with a linear scale sensor 322, slits formed at the same intervals at a linear scale 321 which is arranged approximately parallel to the scanning direction X at the vicinity of the carriage guide shaft 51. Then, the linear encoder 32 inputs a detection signal which varies according to a moving amount of the carriage 61 in the scanning direction X into the control unit 100. The control unit 100 detects a position of the carriage 61 based on the input signal. The recording head 62 mounted on the carriage 61 is provided with a plurality of ink discharge ports. The recording head 62 discharges ink supplied from an ink cartridge (not illustrated) from the respective ink discharge ports according to a driving signal from the control unit 100.

The platen 52 which is arranged to face the recording head 62 and on which the conveyed recording sheet P is placed includes a rib 52*b* which maintains an interval between the recording surface of the recording sheet P and a head surface of the recording head 62 at a predetermined interval while supporting the recording sheet P in a slidingly contacted manner. A plurality of the ribs 52 which are shaped to extend in the sub-scanning direction Y are arranged at predetermined intervals in the scanning direction X.

In the following, functions of the ribs 52*b* will be described. When ink droplets are discharged from the recording head 62 onto the recording sheet P, a phenomenon that the recording sheet P is swelled and rippled in the scanning direction X by absorbing the ink (i.e., a cockling phenomenon) occurs. When such a cockling phenomenon occurs at the recording sheet P placed on a flat surface, for example, a distance between the recording surface of the recording sheet P and the recording head 62 becomes uneven and the recording quality decreases due to irregular ripples. In some cases, the recording sheet P is rubbed against the recording head 62 and the recording surface may be defaced.

Figure 4:
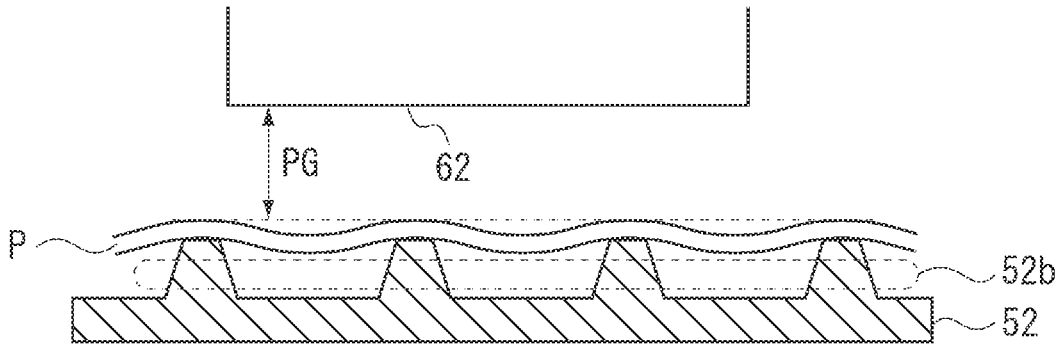
FIG. 4 illustrates a rib on a platen.

To address such situation, the ribs 52*b* extending in the sub-scanning direction Y are arranged on the front surface of the platen 52 at the predetermined intervals in the scanning direction X. The configuration will be described with reference to FIG. 4 which schematically illustrates a section of the platen 52, the ribs 52*b*, the recording sheet P, and the recording head 62 along an alternate long and short dash line Z in FIG. 1. As is apparent from FIG. 4, by arranging the ribs 52*b*, parts of the recording sheet P corresponding to middle positions between adjacent two ribs sag under own weight and apexes of the cockling are formed by the ribs 52*b*. Consequently, a regular cockling state having a constant cycle is compulsory formed at the recording sheet P, so that a distance PG between the recording surface and the recording head 62 is maintained to be approximately even.

Referring to FIGS. 1 and 2, the inkjet recording apparatus 50 configured as described above performs recording on the recording sheet P by alternately repeating the conveying operation and scanning operation. The conveying operation is to convey the recording sheet P by a predetermined conveyance amount in the sub-scanning direction Y between the carriage 61 and the platen 52 or to stop the conveyance. The scanning operation is to discharge ink onto the stopped recording sheet P from the recording head 62 while the carriage 61 is moved in the scanning direction X.

A sheet discharge roller 55 arranged at the most downstream side in the sub-scanning direction Y of the recording sheet P discharges the recorded recording sheet P by rotating in the sub-scanning direction Y. When the recording sheet P is discharged by the rotation of the sheet discharge roller 55, a plurality driven sheet discharge rollers 56 is driven and rotated as following to discharge of the recording sheet P while contacting to the recording sheet P. Accordingly, the recording sheet P is discharged as being closely contacted to the sheet discharge roller 55. A known capping device 59 is arranged at one end side (for example, at the left outside) of the reciprocating area of the carriage 61 in the scanning direction X. During standby as not to perform recording, the carriage 61 moves onto the capping device 59 and stops. Then, the recording head 62 is sealed by a cap CP provided on the capping device 59. A stop position of the carriage 61 is defined as a home position HP.

Figure 5:
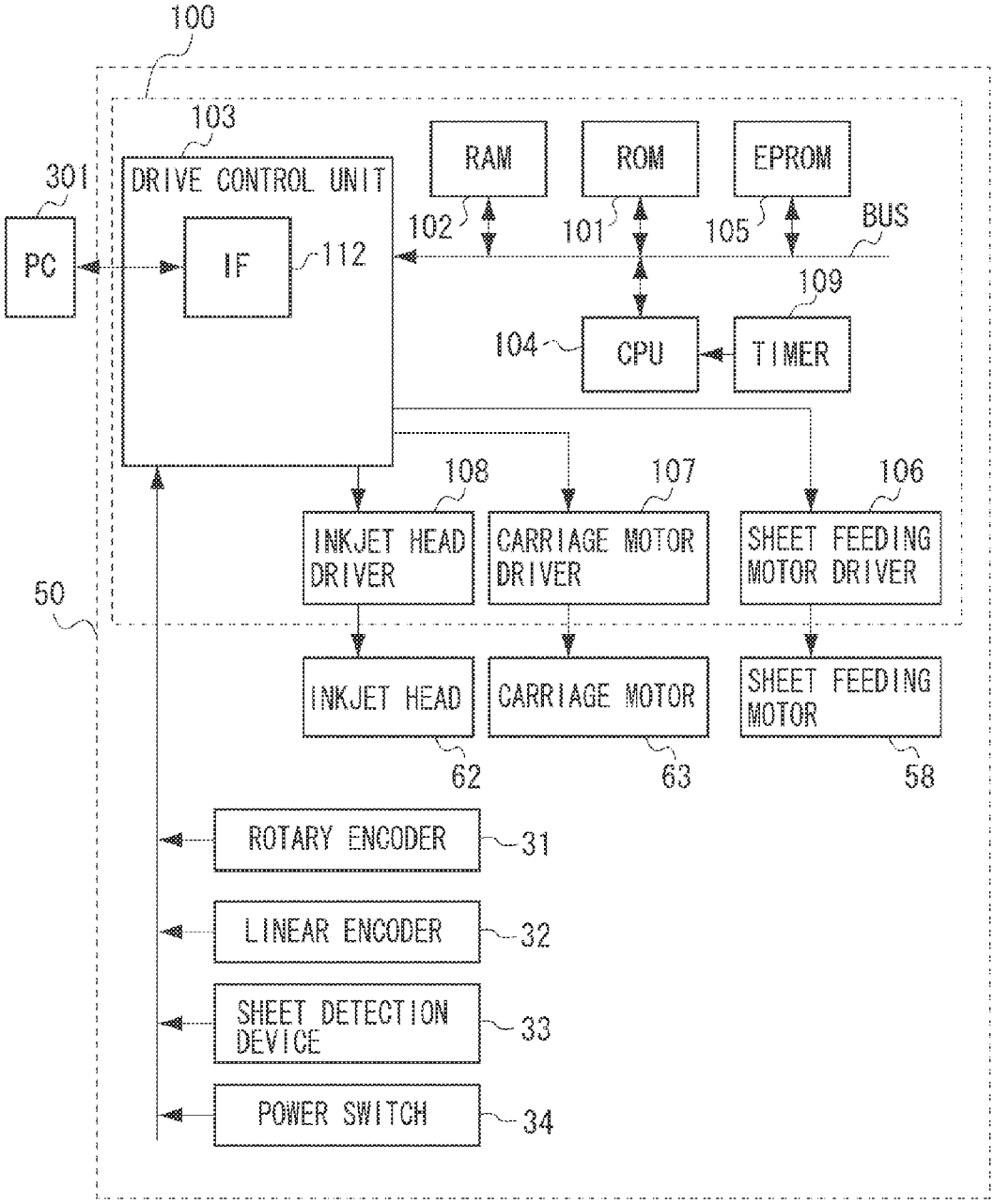
FIG. 5 is a schematic structural view of a control unit of the inkjet recording apparatus.

FIG. 5 is a schematic structural view of the control unit 100 of the inkjet recording apparatus 50. In the following, operational control of the inkjet recording apparatus 50 by the control unit 100 will be described with reference to FIG. 5 along with FIGS. 1 and 2.

A read-only memory (ROM) 101, a random access memory (RAM) 102, a drive control unit 103, a central processing unit (CPU) 104, and an erasable programmable ROM (EPROM) 105 are connected to a system bus of the control unit 100. The CPU 104 performs a logic operation or the like to perform recording control of the inkjet recording apparatus 50 using the RAM 102 as a work area according to a recording control program stored in the ROM 101. Various pieces of data required for processing of the recording control program are read from and written at the EPROM 105. A logically generated control command is input into the drive control unit 103. The CPU 104 generates recording data based on a recording command received from a personal computer 301 of a host side via an interface 112 provided on the drive control unit 103 and inputs the recording data to the drive control unit 103.

Various detection signals and output singles are input into the CPU 104. The CPU 104 performs a logic operation of the control command to be input to the drive control unit 103 based on the inputs thereof. The detection signals include a detection signal from the rotary encoder 31 which detects a rotational amount of the sheet conveyance roller 53, a detection signal from the sheet detection device 33 which detects the leading edge HD of the conveyed recording sheet P, and a detection signal from the linear encoder 32 which detects the moving amount of the carriage 61 via the drive control unit 103. Further, an output signal of a power switch 34 which performs ON/OFF of a power source of the inkjet recording apparatus 50 is input to the CPU 104.

The drive control unit 103 includes an application specific integrated circuit, for example, and logically generates a control signal of a carriage motor 63 based on the control command and recording data input from the CPU 104. The generated control signal is transmitted to a carriage motor driver 107 and the carriage motor driver 107 transmits a driving signal corresponding thereto to the carriage motor 63, so that the carriage motor 63 can rotationally operates. Rotational driving force of the carriage motor 63 is transmitted to the carriage 61 by a belt transmission mechanism, so that the carriage 61 can perform a reciprocating operation in the scanning direction X along the carriage guide shaft 51.

The drive control unit 103 generates an ink discharge control signal with timing synchronized with the operation of the carriage 61 based on the recording data input from the CPU 104 and the input signal from the linear encoder 32 and transmits the ink discharge control signal to a recording head driver 108. Then, the recording head driver 108 transmits a driving signal to the recording head 62. Accordingly, the recording head 62 is driven according to the movement of the carriage 61 and discharge of ink droplets is performed corresponding to the recording data.

Further, the drive control unit 103 logically generates a control signal for providing sheet conveyance timing corresponding to the reciprocating operation of the carriage 61 and transmits the control signal to a sheet conveyance motor driver 106. The sheet conveyance motor driver 106 transmits a driving signal corresponding to the input signal thereof to a sheet conveyance motor 58. The rotational drive force of the sheet conveyance motor 58 is transmitted to the sheet conveyance roller 53, the sheet feeding roller 57*b*, and the sheet discharge roller 55. Accordingly, these rollers rotate and perform feeding, conveyance, and discharge of the recording sheet P at appropriate timing for the ink discharge operation.

The CPU 104 detects a conveyance amount of the recording sheet P from the position detected by the sheet detection device 33 at which the recording sheet P is determined being placed on the platen 52 based on the detection signals of the rotary encoder 31 and the sheet detection device 33 input via the drive control unit 103. The CPU 104 receives the detection signal from the rotary encoder 32 via the drive control unit 103 and stores the data based on the signal to the RAM 102.

In the following, exemplary embodiments of the present invention having the above apparatus configuration will be described.

Figure 6:
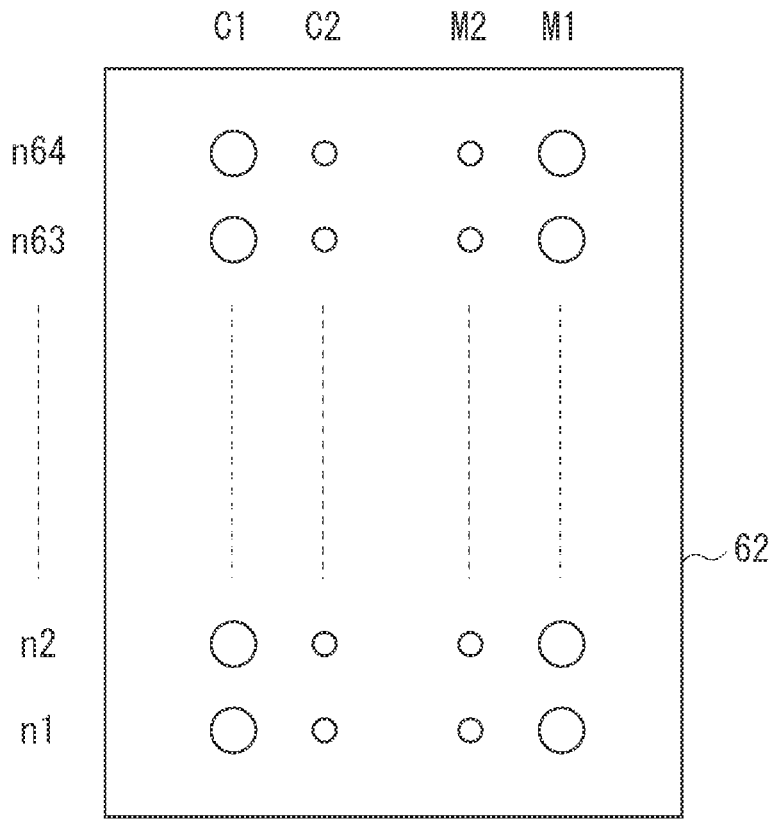
FIG. 6 is a structural view of a recording head used in a first exemplary embodiment.

FIG. 6 illustrates the recording head 62 according to a first exemplary embodiment of the present invention. Four rows of nozzle arrays are arranged on the recording head 62 along the scanning direction X in the order of a cyan array C1, a cyan array C2, a magenta array M2, and a magenta array M1. Each nozzle array includes 64 (=n) pieces of ink discharge ports (i.e., nozzles) in a density of 600 (=N) pieces per inch in the sub-scanning direction Y (i.e., 600 dpi). In FIG. 6, a nozzle number is denoted as n1 to n64. The cyan array C1 and the magenta array M1 are nozzle arrays which discharge ink droplets of relatively large discharge amount and a size of the ink droplets is approximately 5 pl. The cyan array C2 and the magenta array M2 are nozzle arrays which discharge ink droplets of relatively small discharge amount and the size of the ink droplets is approximately 2 pl. The respective four arrays are driven at a drive frequency of 30 KHz and a discharge speed of approximate 12 mm/s. Heating elements are arranged corresponding to the ink discharge ports respectively one element for each port.

Figure 7:
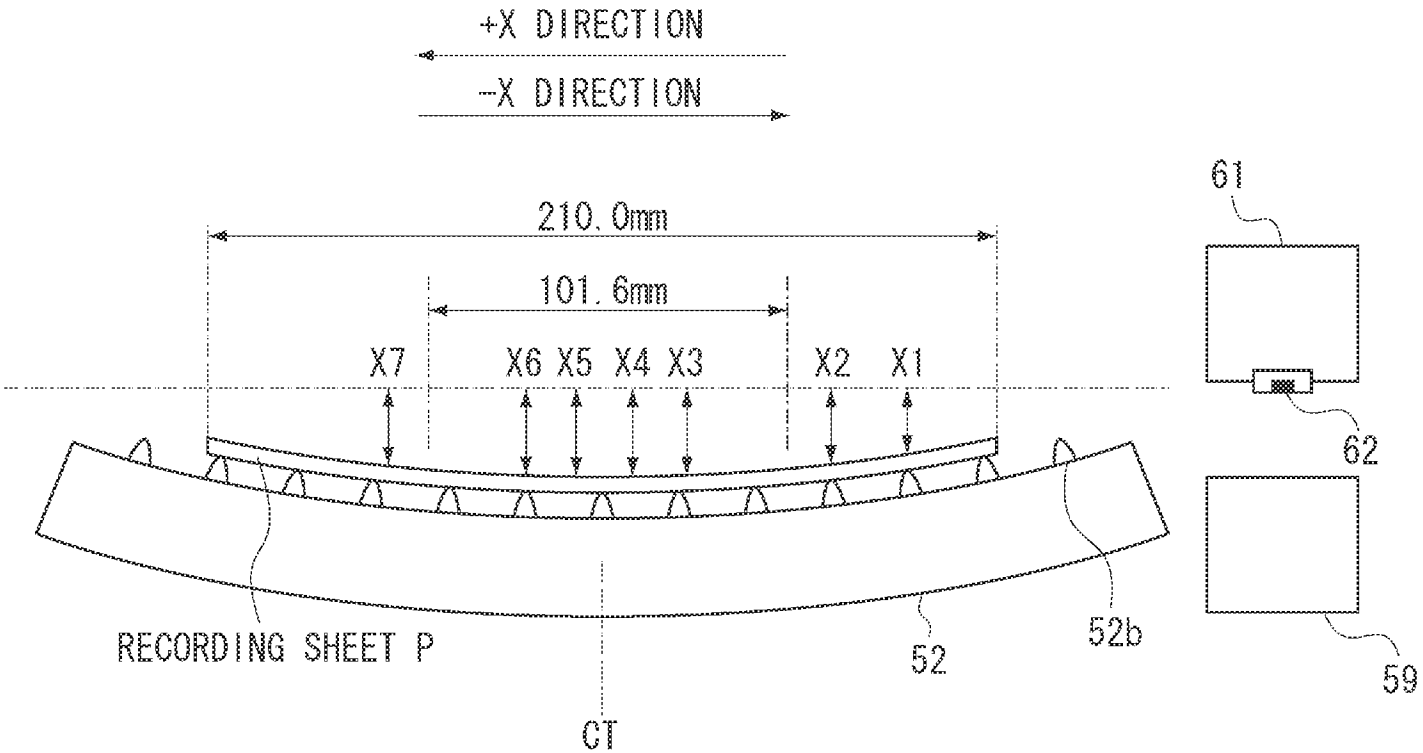
FIG. 7 illustrates a positional relation between a recording sheet and a platen.

FIG. 7 illustrates a recording position of a recording position adjustment pattern in the present exemplary embodiment. The recording sheet P of A4 size plain paper mainly used for documents and graphics has width of 210.0 mm. The recording sheet P of 4×6 inch size (i.e., KG size) photo-dedicated paper mainly used for photo images has width of 101.6 mm. Either of the recording sheets is fed and conveyed from the back to the front with reference to the center CT of the conveyance path W. The carriage 61 mounting the recording head 62 performs recording by discharging ink onto the recording surface of the recording sheet P which is supported by the ribs 52*b* on the platen 52 while scanning backward and forward in the forward direction of the scanning direction (i.e., +X direction) and the backward direction (i.e., −X direction).

In the present exemplary embodiment, a test pattern for a plurality of kinds of items including a recording position deviation between the forward direction and the backward direction is recorded on the recording sheet of A4 size as a recordable maximum size along the scanning direction. The test pattern for the plurality of kinds of items including the recording position deviation between the forward direction and the backward direction is recorded at positions X1 to X7. Positions X1, X2, and X7 are at an inner side of A4 size in the scanning direction and at an outer side of 4×6 inch size (i.e., KG size) in the scanning direction. Positions X3, X4, X5, and X6 are at an inner side of 4×6 inch size (i.e., KG size) in the scanning direction and at the vicinity of the center CT of the conveyance path W.

When deformation is generated at the platen 52 supporting the recording sheet due to manufacturing variation, the distance from the recording head 62 to the recording surface of the recording sheet (i.e., a paper gap) varies in the scanning direction. Particularly, the platen 52 is apt to deform to be concave at the vicinity of the center as illustrated in FIG. 7. Accordingly, the paper gaps often differ at the center and an edge of the platen 52. More specifically, there occurs paper gap variation to the extent that a paper gap PGX1 at a position X1 is to be approximate 1.0 mm and a paper gap PGCT at the center CT is to be approximate 1.2 mm.

Figure 8:
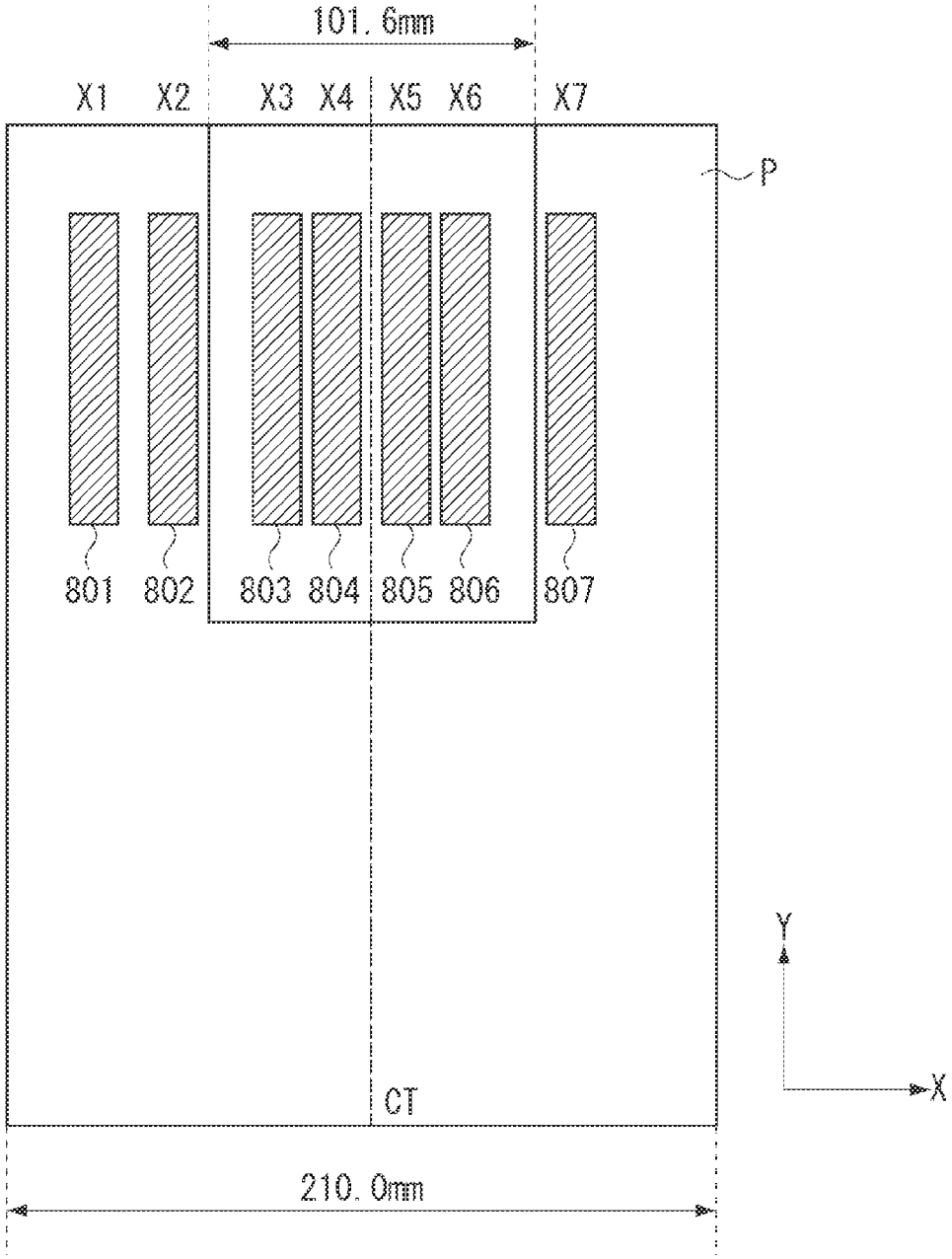
FIG. 8 illustrates arrangement of test patterns on a recording sheet of the first exemplary embodiment.

FIG. 8 illustrates a pattern arrangement when each test pattern for performing the recording position adjustment is recorded on the recording sheet P of A4 size. A test pattern 801 for adjusting recording position deviation caused by inclination of the recording head is recorded at the position X1. For generating the test pattern 801, the cyan array C1 which discharges ink droplets of 5 pl representing four rows of nozzle arrays of cyan and magenta is utilized. A test pattern 802 for adjusting recording position deviation between the nozzle arrays of the cyan array C1 of discharge amount 5 pl and the cyan array C2 of discharge amount 2 pl is recorded at the position X2. A test pattern 807 for adjusting recording position deviation between the nozzle arrays of the magenta array M1 of discharge amount 5 pl and the magenta array M2 of discharge amount 2 pl is recorded at the position X7. In this manner, patterns for adjusting the recording position deviation caused by the nozzle array inclination and the recording position deviation between the nozzle arrays are recorded at the positions X1, X2, and X7 which are on the outside of 4×6 inch size (i.e., KG size) in the scanning direction.

A test pattern 803 for adjusting recording position deviation between the forward direction and the backward direction with the cyan array C1 of discharge amount 5 pl is recorded at the position X3. Similarly, a test pattern 804 for adjusting recording position deviation between the forward direction and the backward direction with the cyan array C2 of discharge amount 2 pl is recorded at the position X4. A test pattern 805 for adjusting recording position deviation between the forward direction and the backward direction with the magenta array M2 of discharge amount 2 pl is recorded at the position X5. A test pattern 806 for adjusting recording position deviation between the forward direction and the backward direction with the magenta array M1 of discharge amount 5 pl is recorded at the position X6. In this manner, patterns for adjusting the recording position deviation between the forward direction and the backward direction are recorded sequentially in the scanning direction at the positions X3 to X6 which are on the inner side of 4×6 inch size (i.e., KG size) in the scanning direction.

Figure 9:
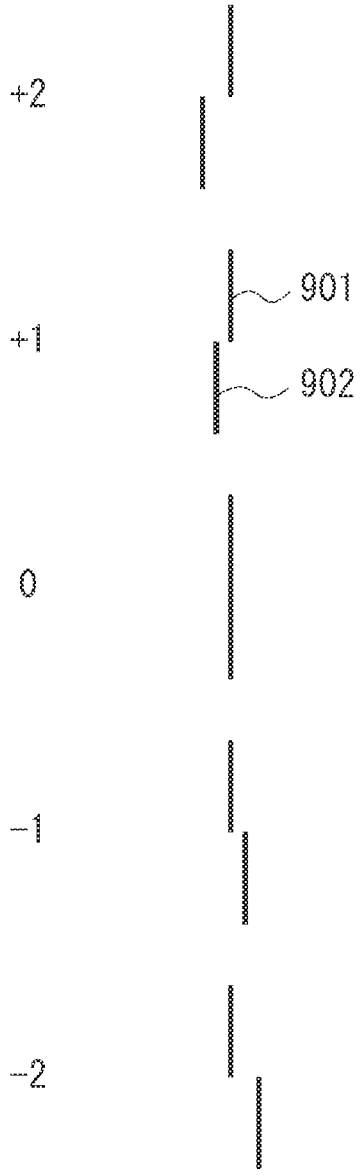
FIG. 9 illustrates details of a test pattern for recording position adjustment of forward and backward directions.

FIG. 9 illustrates details of the test pattern for adjusting the recording position deviation between the forward direction and the backward direction. A vertical ruled line 901 is a ruled line pattern recorded by 64 pieces of nozzles of each nozzle array with scanning in the forward direction. A vertical ruled line 902 is a ruled line pattern recorded by 64 pieces of nozzles of each nozzle array with scanning in the backward direction. The recording of these patterns is performed on recording conditions of a carriage speed of 25 inch/s and a drive frequency of 30 KHz. The test pattern for adjusting the recording position deviation between the forward direction and the backward direction is completed with five patterns by changing recording timing of the vertical ruled line 902 from "−2" to "+2" in 1200 dpi at five steps with respect to the vertical ruled line 901. Here, the minus direction indicates forwarding the recording timing and the plus direction indicates delaying the recording timing. Such a test pattern is recorded respectively as the test patterns 803 to 806.

The test patterns 802 and 807 for adjusting the recording position deviation between the nozzle arrays have the same configuration as of the test pattern in FIG. 9. However, a method for recording the test pattern is not the same as that of FIG. 9. More specifically, in the test pattern for adjusting the recording position deviation between the nozzle arrays, the vertical ruled line 901 is recorded by nozzle arrays C1 and M1 which have relatively large discharge amount and the vertical ruled line 902 is recorded by the nozzle arrays C2 and M2 which have relatively small discharge amount.

The recording position adjustment is performed by selecting a pattern which includes the smallest deviation between two ruled lines among the test patterns in FIG. 9 and by being based on the recording timing (i.e., an adjustment value) when a non-referential vertical ruled line of the pattern is recorded. In the recording apparatus which includes an optical sensor on the carriage, detection of the pattern including the smallest deviation between the two vertical lines may be automatically performed. Further, it is also possible that a user inputs a value of the pattern including the smallest deviation between the two vertical ruled lines from an operation unit after checking the recording sheet on which the test pattern has been recorded.

Figure 10:
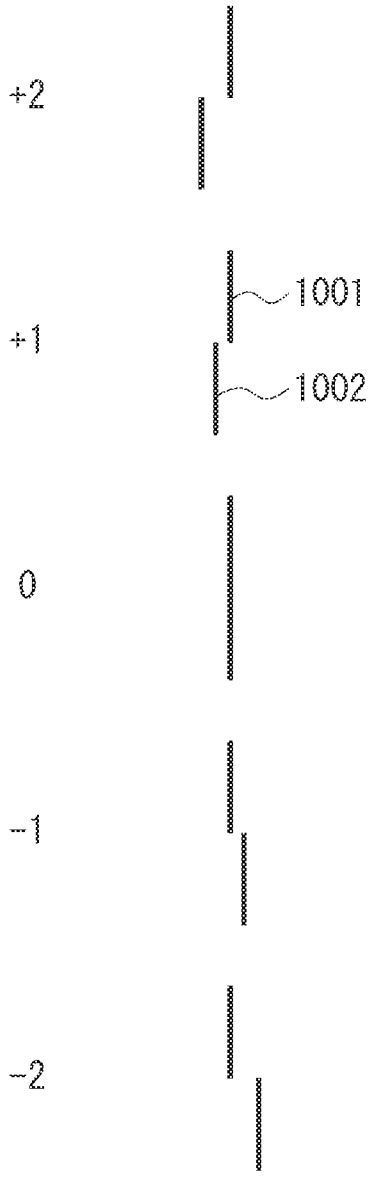
FIG. 10 illustrates details of a test pattern for inclination adjustment of a recording head.

FIG. 10 illustrates details of the test pattern for adjustment of the recording position deviation due to the recording head inclination. A vertical ruled line 1001 is a ruled line pattern recorded using 16 pieces of nozzles n49 to n64 at the upstream side of the cyan array C1 with scanning in the forward direction. A vertical ruled line 1002 is a ruled line pattern recorded using 16 pieces of nozzles n1 to n16 at the downstream side of the cyan array C1 with scanning in the forward direction as well after the vertical ruled line 1001 is recorded and the recording sheet P is conveyed. As illustrated by "−2" to "+2" in FIG. 10, the vertical ruled line pattern 1002 is recorded as the recording timing to be forwarded with the minus direction and to be delayed with the plus direction in 1200 dpi respectively with respect to the vertical ruled pattern 1001.

In the adjustment of the recording position deviation due to the recording head inclination, first, a pattern which includes the smallest deviation between the two ruled lines is selected among the test patterns in FIG. 10. Then, the degree of the inclination (i.e., the adjustment value) is detected based on the recording timing (i.e., the deviation in the scanning direction) when the non-referential vertical ruled line of the pattern is recorded. When an actual image is recorded, the recording position deviation is corrected by dividing the plurality of nozzles in each nozzle array into a plurality of groups and shifting the drive timing by one dot unit for each group according to the inclination.

Figure 11:
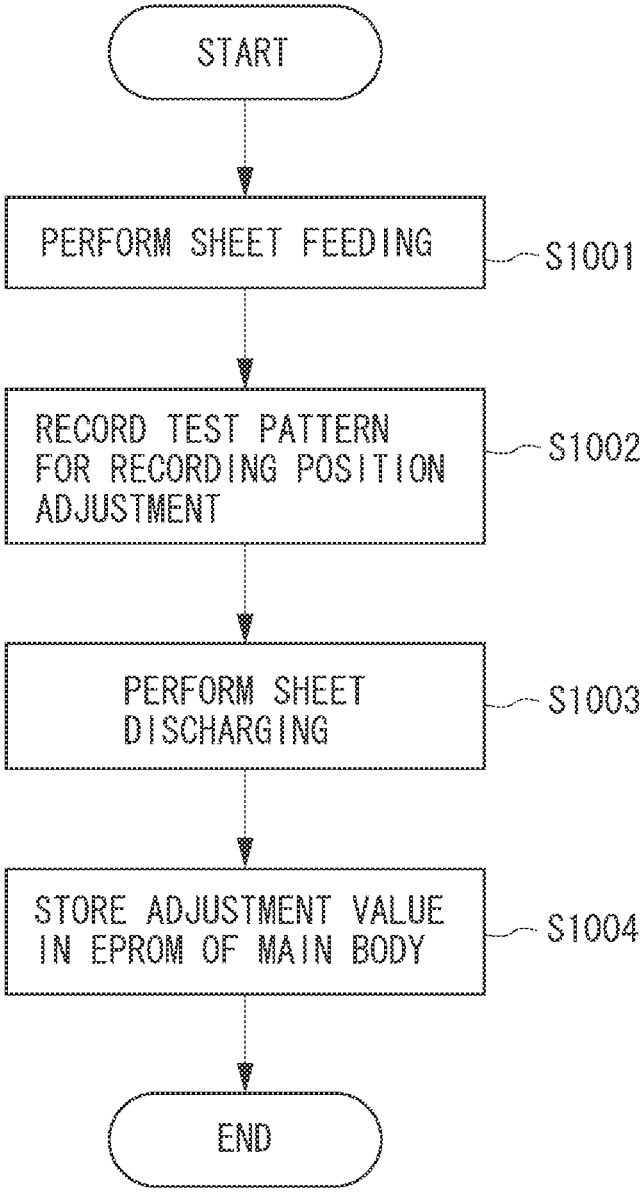
FIG. 11 is a flowchart regarding recording position adjustment.

FIG. 11 is a flowchart of the recording position adjustment according to the present invention. Such a process is automatically performed at the timing when the recording apparatus is firstly turned on and when the recording head is replaced. In addition, the process can be performed at arbitrary timing based on a user's instruction via the operation unit of the recording apparatus.

First, in step S1001, a recording sheet is fed for recording a test pattern for recording position adjustment. The present exemplary embodiment is configured to record the test pattern on the recording sheet of A4 size. Next, in step S1002, the recording apparatus records the test patterns 801 to 807 on the fed recording sheet along the sheet scanning direction, as illustrated in FIG. 8. In step S1003, when all of the test patterns 801 to 807 are recorded on the recording sheet in all patterns of "−2" to "+2", the recorded recording sheet is discharged. In step S1004, adjustment values are selected from respective test patterns recorded on the recording sheet, and the EPROM as a storage unit of the main body of the apparatus stores the adjustment values.

Among the recording position deviations, the recording position deviation between the forward direction and the backward direction is more influenced by the variation of the paper gap. The amount of the recording position deviation between the forward direction and the backward direction varies as the paper gap varies. For example, when concave deformation occurs at the platen 52 as illustrated in FIG. 7, appropriate recording position adjustment cannot be performed at the center CT of the platen 52 even when the recording position deviation between the forward direction and the backward direction is adjusted at the platen edge of position X1. However, in the present exemplary embodiment, the test pattern for adjusting the recording position deviation between the forward direction and the backward direction is recorded at the position in the scanning direction where both of the recording sheet of A4 size and the recording sheet of 4×6 inch size (i.e., KG size) pass. Accordingly, the recording position adjustment in the forward direction and the backward direction is appropriately performed in the area where the recording sheet of 4×6 inch size (i.e., KG size) passes, so that an influence by the recording position deviation between the forward direction and the backward direction can be suppressed even when an image is recorded on the recording sheet of 4×6 inch size (i.e., KG size) mainly being photo-dedicated paper. When an image is recorded on the recording sheet of A4 size, there may be a case that the recording position deviation between the forward direction and the backward direction is not adjusted at an edge of the scanning direction. However, the recording sheet of A4 size mainly being plain paper is not much influenced by that.

As described above, the present exemplary embodiment may be widely adopted to a recording apparatus which can perform image recording on a first recording medium of A4 size, for example, and on a second recording medium of 4×6 inch size (i.e., KG size), for example, which has a different size from the first recording medium. More specifically, in the present exemplary embodiment, a test pattern for adjusting recording position deviation between the forward direction and the backward direction is recorded sequentially in the scanning direction at a predetermined position of the first recording medium without sandwiching another pattern when a plurality of test patterns (for example, a pattern for adjusting recording position deviation between the forward direction and the backward direction and a pattern for adjusting recording position deviation between different nozzle arrays) are recorded along the scanning direction. The predetermined position is a position through which both of the first recording medium and the second recording medium pass in the scanning direction.

With the above configuration, high quality image recording can be performed in image recording on the small-sized second recording medium while suppressing the influence of the recording position deviation between the forward direction and the backward direction. In the present exemplary embodiment, the test pattern for adjusting the recording position deviation between the forward direction and the backward direction is sequentially recorded in the scanning direction. With this configuration, the test patterns for adjusting the recording position deviation between the forward direction and the backward direction of respective nozzle arrays are recorded almost in the same paper gap. Accordingly, the configuration enables more accurate adjustment of the recording position deviation between the forward direction and the backward direction. Particularly, since the small-sized recording medium is mainly photo-dedicated paper and is mainly purposed to view the recorded image at hand, it is totally effective to appropriately perform the recording position adjustment in the forward and backward directions for the small-sized second recording medium.

In the above description, the test pattern for adjusting the recording position deviation between the forward direction and the backward direction is recorded at a position through which both of the recording sheet of A4 size and the recording sheet of 4×6 inch size (i.e., KG size) pass. However, the present exemplary embodiment does not require that all of the test patterns for adjusting the recording position deviation between the forward direction and the backward direction are recorded at the position through which both of the recording sheet of A4 size and the recording sheet of 4×6 inch size (i.e., KG size) pass. For example, when a recording head has a configuration including a number of nozzle arrays, there may be a case that test patterns for recording position adjustment in the forward and backward directions of all of the nozzle arrays cannot be recorded at a position through which both of different size recording media pass. Accordingly, the present exemplary embodiment only requires that the test pattern for the recording position adjustment in the forward and backward directions of at least one nozzle array which is arranged on the recording head is recorded at the position through which both of the recording media pass in the scanning direction.

However, it is desirable that test patterns which cannot be recorded at the position through which both of the recording media pass is recorded at a position as close thereto as possible. Accordingly, to perceive the present exemplary embodiment from another viewpoint, in the case of "center sheet feeding", the test pattern for adjusting recording position deviation between the forward direction and the backward direction is recorded at the center among a plurality of test patterns to be recorded along the scanning direction. With this configuration, the possibility that the recording position deviation between the forward direction and the backward direction can be adjusted at the area through which the second recording medium of 4×6 inch size (i.e., KG size) passes increases to enhance the effects of the present invention. In the "center sheet feeding", when the recording head includes a nozzle array of large ink droplets (i.e., a first nozzle array) and a nozzle array of small ink droplets (i.e., a second nozzle array), it is desirable that a test pattern of small ink droplets is arranged at the inner side of a test pattern of large ink droplets. This configuration can reduce the recording position deviation of the small ink droplets which largely affect to granularity in a photo image. The configuration in which a recording medium is conveyed with reference to an edge portion of a conveyance path only requires to record the test pattern for adjusting the recording position deviation between the forward direction and the backward direction to the most outer side at a conveyance referential side among the plurality of test patterns to be recorded along the scanning direction.

In an apparatus which can adjust recording modes and a distance between a recording head and a platen in a plurality of steps, there may be a case to record test patterns for recording position adjustment for each recording condition such as each recording mode and each distance. When the test pattern for recording position adjustment is recorded for each recording condition, the recording is not necessarily performed as the present exemplary embodiment at all of the recording conditions. The recording may be performed as the present exemplary embodiment in one recording condition among them.

A second exemplary embodiment describes a recording apparatus which includes a nozzle array not to be used for image recording on a recording sheet of 4×6 inch size (i.e., KG size) mainly being photo-dedicated paper and a nozzle array to be used therefor.

Figure 12:
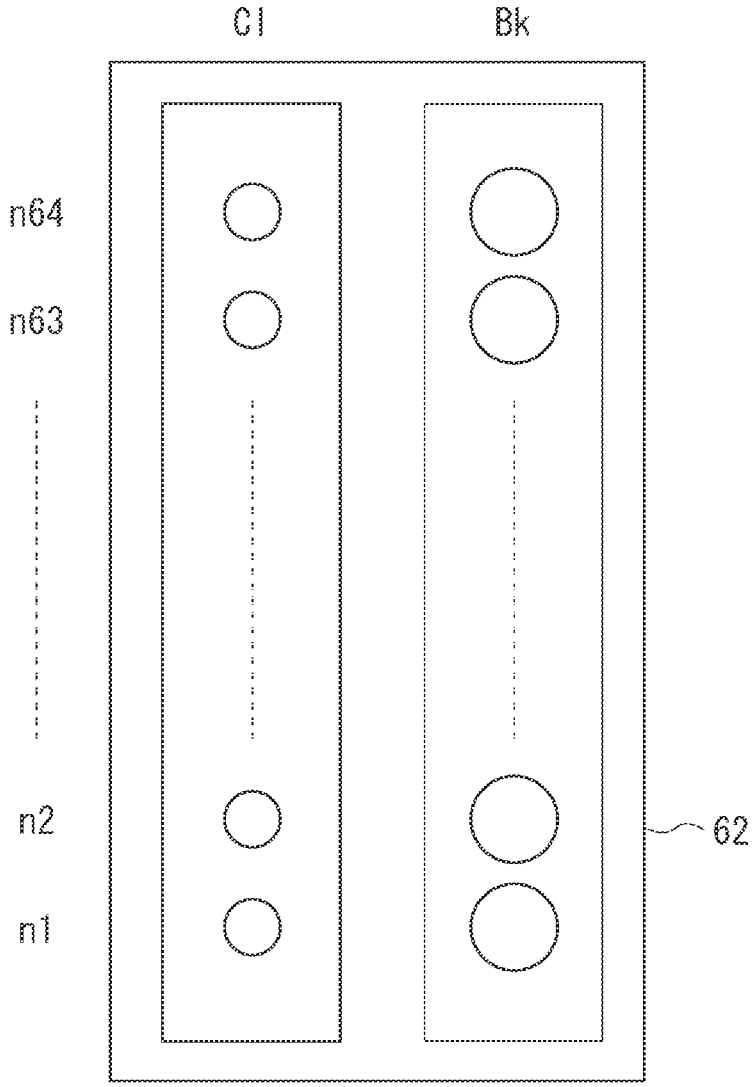
FIG. 12 is a structural view of a recording head according to a second exemplary embodiment.

FIG. 12 illustrates a recording head according to the present exemplary embodiment. The recording head illustrated in FIG. 12 includes two arrays of a color array C1 and a black array Bk respectively having 64 (=n) pieces of ink discharge ports (i.e., 64 nozzles) in a density of 600 pieces (=N) per inch in the sub-scanning direction. The color array C1 discharges dye color ink and the black array Bk discharges pigment black ink. FIG. 12 indicates nozzle numbers as n1 to n64. Volume of ink droplets discharged from the nozzles of the color array C1 is approximately 5 pl and volume of ink droplets discharged from the nozzles of the black array Bk is approximately 15 pl. Both of the color array C1 and the black array Bk are driven at a drive frequency of 30 KHz and discharge speed of approximate 12 mm/s. Heating elements are arranged corresponding to the ink discharge ports respectively one element for each nozzle.

Figure 13:
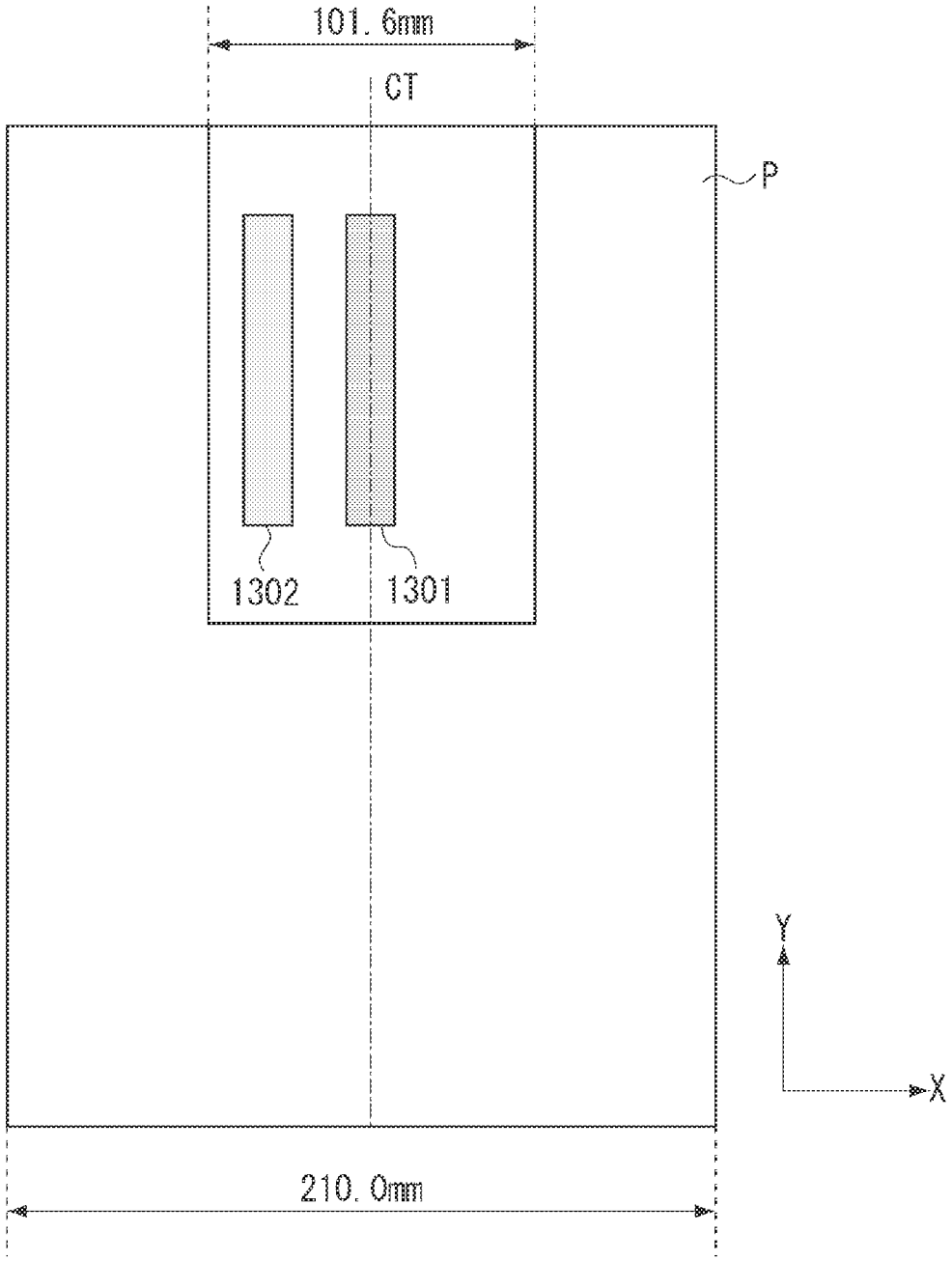
FIG. 13 illustrates arrangement of test patterns on a recording sheet of the second exemplary embodiment.

FIG. 13 illustrates a pattern arrangement when each test pattern for performing the recording position adjustment is recorded on the recording sheet P of A4 size. A test pattern 1301 for adjusting the recording position deviation between the forward direction and the backward direction of the color array C1 is recorded at a position of a center CT of a conveyance path WT. The color array C1 is a nozzle array which is used for image recording on both of a recording sheet of A4 size mainly being plain paper and a recording sheet of 4×6 inch size (i.e., KG size) mainly being photo-dedicated paper. Similarly, a test pattern 1302 for adjusting the recording position deviation between the forward direction and the backward direction of the black array Bk is recorded at a position X3 (which is equivalent to the position X3 in FIG. 8). The black array Bk is a nozzle array which is used for the recording sheet of A4 size mainly being plain paper but not used for the recording sheet of 4×6 inch size (i.e., KG size) mainly being photo-dedicated paper. In the present exemplary embodiment, the recording position adjustment is performed based on the test pattern recorded as illustrated in FIG. 13 according to the flowchart in FIG. 11 used in the first exemplary embodiment.

In this manner, the present exemplary embodiment arranges the test pattern for the recording position adjustment of the forward and backward directions of the array C1 (i.e., the second nozzle array) which discharges dye color ink at the inner side from the test pattern of the array Bk (i.e., the first nozzle array) which discharges pigment black ink. Accordingly, the recording position adjustment in the forward and backward directions is appropriately performed at the array C1 which is used for image recording on the recording sheet of 4×6 inch size (i.e., KG size). Therefore, high quality image recording can be performed when an image is recorded on the recording sheet of 4×6 inch size (i.e., KG size) mainly being photo-dedicated paper.

In the above description, a "line-shaped pattern" including two ruled lines is adopted as the test pattern for recording position adjustment. However, the test pattern may adopt a configuration that two "dot-patterns" are shifted in a plurality of steps as discussed in Japanese Patent Application Laid-open No. 07-081190. This test pattern has optical characteristics (i.e., reflection optical density and brightness) which vary according to a shift amount of the two "dot patterns". Accordingly, an amount of recording position deviation can be easily obtained by measuring the optical characteristics.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-157914 filed Jul. 2, 2009, which is hereby incorporated by reference herein in its entirety.

What is claimed is:

1. A printing apparatus for printing an image comprising:

a print head including a first nozzle array for ejecting ink while scanning with the print head in a first direction and a second direction opposite to the first direction;

a print medium supplying unit operable to supply a first print medium and a second print medium to a position for printing by the print head, wherein the second print medium is smaller than the first print medium in a crossing direction across a moving direction of the first and second print medium, and centers of the first and second print media are located at substantially the same position in the crossing direction when the media are conveyed over a platen;

a pattern printing unit configured to cause the print head to print a first test pattern used for determining a first relative timing between an ejection from the first nozzle array, when the print head is scanning in the first direction, and an ejection from the first nozzle array, when the print head is scanning in the second direction, and a second test pattern used for determining a second relative timing of an ejection different from the first relative timing, wherein the first and second test patterns are printed on the first print medium; and a determining unit configured to determine the first relative timing based on the first test pattern printed by the pattern printing unit and the second relative timing based on the second test pattern printed by the pattern printing unit, wherein the pattern printing unit is further configured to print the first and second test patterns such that the first test pattern is printed at a position at which the second test pattern is printed in the moving direction and within a range of the centers of the first and second print media in the crossing direction, when the media are over the platen.

2. The printing apparatus according to claim 1, wherein the first test pattern consists of a plurality of first patterns, each being formed by ejecting ink from the first nozzle array in the scanning of the print head in both of the first and second directions, and the first relative timing between the ejections when the print head is scanning in the first and second directions varies according to the first patterns.

3. The printing apparatus according to claim 1, wherein the pattern printing unit is configured to print the second test pattern at a position on the first print medium in the crossing direction at which the second print medium is not supplied.

4. The printing apparatus according to claim 1, wherein the print head further comprises at least a second nozzle array; and the second relative timing includes a relative timing between an ejection from the first nozzle array, when the print head is scanning in one of the first and second directions and an ejection from the second nozzle array, when the print head is scanning in the one of the first and second directions.

5. The printing apparatus according to claim 1, wherein the print head has a plurality of nozzle arrays including a first nozzle array used for printing the first test pattern and a second nozzle array ejecting ink with a larger amount than the first nozzle array; and the second relative timing includes a relative timing between an ejection from the second nozzle array, when the print head is scanning in the first direction and an ejection from the second nozzle array when the print head is scanning in the second direction.

6. A printing method for printing an image by using a print head including a nozzle array for ejecting ink while scanning with the print head in a first direction and a second direction opposite to the first direction, comprising:

supplying a first print medium and a second print medium to a position for printing by the print head, wherein the second print medium is smaller than the first print medium in a crossing direction across a moving direction of the first and second print medium, and centers of the first and second print media are located at substantially the same position in the crossing direction when the media are conveyed over a platen;

causing the print head to print a first test pattern used for determining a first relative timing between an ejection from the nozzle array, when the print head is scanning in the first direction, and an ejection from the nozzle array, when the print head is scanning in the second direction, and a second test pattern used for determining a second relative timing of an ejection different from the first relative timing;

wherein the first and second test patterns are printed on the first print medium; and determining the first and second relative timings, wherein the first test pattern is printed at a position where the second test pattern is printed in the moving direction and within a range of the centers on the first and second print media in the crossing direction, when the media are over the platen.

7. The printing method according to claim 6, wherein the first test pattern is consisted of a plurality of first patterns, each being formed by ejecting ink from the nozzle array in the scanning of the print head in both the first and second directions, and the first relative timing between the ejections when the print head is scanning in the first and second direction varies according to the first patterns.

8. The printing method according to claim 6, wherein the second test pattern is printed at the position on the first print medium along the crossing direction where the second print medium is not supplied.

9. The print method according to claim 6, wherein the print head has a plurality of nozzle arrays including a first nozzle array and a second nozzle array; and the second test pattern is used for determining a relative timing between an ejection from the first nozzle array when the print head is scanning in one of the first and second directions and an ejection from the second nozzle array when the print head is scanning in the one of the first and second directions.

10. The printing method according to claim 6, wherein the print head has a plurality of nozzle arrays including a first nozzle array used for printing the first test pattern and a second nozzle array ejecting ink with a larger amount than the first nozzle array; and the second relative timing includes a relative timing between an ejection from the second nozzle array when the print head is scanning in the first direction and an ejection from the second nozzle array when the print head is scanning in the second direction.

11. A non-transitory storage medium storing a computer-executable program for printing an image by using a print head including a nozzle array for ejecting ink while scanning with the print head in a first direction and a second direction opposite to the first direction, the computer-executable program containing a method comprising:

supplying a first print medium and a second print medium to a position for printing by the print head, wherein the second print medium is smaller than the first print medium in a crossing direction across a moving direction of the first and second print medium, and centers of the first and second print media are located at substantially the same position in the crossing direction when the media are conveyed over a platen;

causing the print head to print a first test pattern used for determining a first relative timing between an ejection from the nozzle array, when the print head is scanning in the first direction, and an ejection from the nozzle array, when the print head is scanning in the second direction, and a second test pattern used for determining a second relative timing of an ejection different from the first relative timing;

wherein the first and second test patterns are printed on the first print medium; and determining the first and second relative timings, wherein the first test pattern is printed at a position where the second test pattern is printed in the moving direction and within a range of the centers on the first and second print media in the crossing direction, when the media are over the platen.

12. The non-transitory storage medium storing a computer-executable program according to claim 11, wherein the first test pattern is consisted of a plurality of first patterns, each being formed by ejecting ink from the nozzle arrays in the scanning of the print head in both of the first and second directions, and the first relative timing between the ejection when the print head is scanning in the first direction and the ejection when the print head is scanning in the second direction varies according to the first patterns.

13. The storage medium storing a computer-executable program according to claim 11, wherein the second test pattern is printed at a position on the first medium in the crossing direction where the second print medium is not supplied.

14. The non-transitory storage medium storing a computer-executable program according to claim 11, wherein the print head has a plurality of nozzle arrays including a first nozzle array and a second nozzle array, and the second test pattern is used for determining a the second relative timing between an ejection from the first nozzle array when the print head is scanning in one of the first and second directions and an ejection from the second nozzle array when the print head is scanning in the one of the first and second directions.

15. The non-transitory storage storing a computer-executable program according to claim 11, wherein the print head has a plurality of nozzle arrays including a first nozzle array used for printing the first test pattern and a second nozzle array ejecting ink with a larger amount relative to the first nozzle array, and the second relative timing includes a relative timing between an ejection from the second nozzle array when the print head is scanning in the first direction and an ejection from the second nozzle array when the print head is scanning in the second direction.

* * * * *